US008341975B2

(12) United States Patent
Knoll et al.

(10) Patent No.: US 8,341,975 B2
(45) Date of Patent: Jan. 1, 2013

(54) WATER DISPENSER

(75) Inventors: George W. Knoll, Belvidere, IL (US); Chester F. Robards, Jr., Flora, MS (US); Kerry D. Roosmalen, Madison, MS (US)

(73) Assignee: Natural Choice Corporation, Rockford, IL (US)

( * ) Notice: Subject to any disclaimer, the term of this patent is extended or adjusted under 35 U.S.C. 154(b) by 239 days.

(21) Appl. No.: 12/927,672

(22) Filed: Nov. 22, 2010

(65) Prior Publication Data

US 2011/0068125 A1 Mar. 24, 2011

Related U.S. Application Data

(62) Division of application No. 11/728,459, filed on Mar. 26, 2007, now Pat. No. 7,861,550.

(51) Int. Cl.
*F25D 3/00* (2006.01)

(52) U.S. Cl. ..... 62/389

(58) Field of Classification Search ..... 62/389, 62/390; 222/1, 52–66, 129.1, 129.4, 146.1, 222/164.6, 183, 185, 185.1, 189.09, 190, 222/330, 335, 464.1, 464.3, 640, 642–643
See application file for complete search history.

(56) References Cited

U.S. PATENT DOCUMENTS

| | | | | |
|---|---|---|---|---|
| 603,465 | A | | 5/1898 | Dodge et al. |
| 2,226,271 | A | | 12/1940 | Vose |
| 2,250,612 | A | | 7/1941 | Tanner |
| 2,384,154 | A | | 12/1944 | Markley, Jr. |
| 2,561,437 | A | | 7/1951 | Cobb |
| 2,622,923 | A | | 12/1952 | Cobb |
| 3,926,342 | A | * | 12/1975 | Selvia et al. ..... 222/129.1 |
| 3,998,070 | A | | 12/1976 | Mueller |
| 4,437,765 | A | | 3/1984 | Seeger |
| 4,597,509 | A | * | 7/1986 | Pereira ..... 222/129 |
| 4,916,910 | A | | 4/1990 | Schroeder |
| 4,932,222 | A | | 6/1990 | Adams, Jr. |
| 4,940,164 | A | | 7/1990 | Hancock et al. |
| 5,022,233 | A | | 6/1991 | Kirschner et al. |
| 5,035,121 | A | | 7/1991 | Cook |
| 5,279,446 | A | | 1/1994 | Cook et al. |
| 5,499,744 | A | | 3/1996 | Hawkins |

(Continued)

*Primary Examiner* — Frantz Jules
*Assistant Examiner* — Emmanuel Duke
(74) *Attorney, Agent, or Firm* — John R. Hoffman

(57) ABSTRACT

A water dispenser is provided for dispensing hot water, cold water, and carbonated water, all of which is filtered. The dispenser includes a housing defining a front dispensing face, a rear face, opposite side walls and a bottom wall. A filter is mounted in the housing and has a rear end connectable to a source of water and a front end accessible at the front face of the housing to facilitate replacing the filter. A dispensing faucet is disposed at the front face of the housing. A hot water tank is located at one side of the housing and has an inlet for receiving filtered water from the filter and a hot water outlet near the dispensing faucet for delivering hot water thereto. An ice bank assembly is located at an opposite side of the housing and has an inlet for receiving filtered water from the filter and a cold water outlet near the dispensing faucet for delivering cold water thereto. A compressor is mounted on the bottom wall of the housing and is coupled to one end of the ice bank evaporator. A condenser coil is mounted at the rear face of the housing and is coupled between the compressor and an opposite end of the evaporator. A carbonator has an inlet for receiving filtered water from the filter and an outlet near the dispensing faucet for delivering carbonated water thereto.

11 Claims, 14 Drawing Sheets

U.S. PATENT DOCUMENTS 5,535,600 A 7/1996 Mills
5,732,563 A 3/1998 Bethuy et al.
5,766,453 A 6/1998 Morellato et al.
5,927,557 A 7/1999 Busick et al.
5,992,684 A * 11/1999 Russell ..... 222/1
6,240,734 B1 6/2001 Ferrier et al.
6,449,966 B1 9/2002 Bethuy et al.
6,516,625 B2 2/2003 Bedard
6,587,203 B2 7/2003 Colon
7,077,293 B2 * 7/2006 McCann et al. ..... 222/129.1

* cited by examiner

WATER DISPENSER

CROSS-REFERENCE TO RELATED APPLICATIONS

This is a division of co-pending application Ser. No. 11/728,459, filed Mar. 26, 2007.

FIELD OF THE INVENTION

This invention generally relates to the art of beverage dispensers and, particularly, to a water dispenser for dispensing hot water, cold water and carbonated water, all of which is filtered.

BACKGROUND OF THE INVENTION

Beverage dispensers come in a wide variety of configurations ranging from large apparatus which might be used in fast food restaurants, for example, to smaller appliances used in a home or office. Regardless of the size of the dispenser, various considerations must be addressed in designing a particular dispenser. The present invention is directed to a water dispenser which involves its own set of considerations.

For instance, as is known, tap water can range from being luke warm to mildly cool in temperature. A water dispenser must be capable of delivering quite cold water for various beverages, if not simply for drinking the cold water, per se. The dispenser should be capable of dispensing hot water for such beverages as coffee or tea. It is highly desirable that the dispenser be capable of filtering the incoming tap water. Another feature of up-scale water dispensers is to provide carbonated water for various beverage purposes.

The present invention primarily is directed to a relatively small water dispenser for use in such applications as a home, an office or the like, whereat the dispenser most likely will be located on top of a countertop in a kitchen or in a break-room in an office or similar environment. Such appliances create their own set of considerations. As but one example, dispenser applications commonly use a reservoir tank to accumulate filtered water. Unfortunately, these apparatus require constant maintenance for the prevention of bacteria and algae growth. Once the water is filtered, there is no residual chlorine to control bacterial growth. Consequently, these reservoir systems often use UV or Ozone, but this adds considerably to the cost, complexity and service requirements of the apparatus. In contrast, the present invention utilizes an ice bank through which filtered water can be continuously cooled and eliminates any reservoir. The ice bank is of a unique configuration.

Space requirements also are of a major consideration in designing a home or office type water dispenser. The space which such an appliance requires on a countertop is critical. The overall layout of the water dispenser of the present invention greatly minimizes the space required for the appliance.

The above and other considerations will be understood with the following specification.

SUMMARY OF THE INVENTION

An object, therefore, of the invention is to provide a new and improved water dispenser of the character described.

Another object of the invention is to provide a water dispenser for dispensing hot water, cold water and/or carbonated water, all of which is filtered.

In the exemplary embodiment of the invention, a housing or housing means define a front dispensing face, a rear face, opposite side walls and a bottom wall of the dispenser. A filter is mounted in the housing and has a rear end connectable to a source of water and a front end accessible at the front face of the housing to facilitate replacing the filter. A dispensing faucet is provided at the front face of the housing. A hot water tank is mounted at one side of the housing and has an inlet for receiving filtered water from the filter and a hot water outlet near the dispensing faucet for delivering hot water thereto. An ice bank assembly is provided at an opposite side of the housing and has an inlet for receiving filtered water from the filter and a cold water outlet near the dispensing faucet for delivering cold water thereto. The ice bank assembly includes a tank containing a cooling liquid bath and an array of cold water coils at one side of the tank immersed in the bath and spaced from a generally flat array of refrigeration or evaporator coils at an opposite side of the tank. The evaporator coils form a generally planar ice bank extending rectilinearly in a direction between the front and rear faces of the housing. The cold water coils are connected to the cold water outlet. A compressor is mounted on the bottom wall of the housing and is coupled to one end of the evaporator coils. A condenser coil is mounted at the rear face of the housing and is coupled between the compressor and an opposite end of the evaporator coils. A carbonator may be provided and includes an inlet for receiving filtered water from the filter and an outlet near the dispensing faucet for delivering carbonated water thereto.

Preferably, the rear face of the housing is defined by a rear wall, and the condenser coil is mounted behind a perforated portion of the rear wall. A fan is provided to the inward side of the condenser coil for blowing air past the condenser coil and out through the perforated portion of the rear wall of the housing.

According to one aspect of the invention, the carbonator is located inside the ice bank assembly. Specifically, the tank of the ice bank assembly is substantially surrounded by insulation, and the carbonator is located within the insulation to maintain the cold temperature of water running through the carbonator. In the preferred embodiment, the carbonator is located inside the tank above the cooling liquid bath in the tank. The carbonator is connected to the cold water coils of the ice bank for receiving cold water therefrom. As disclosed herein, a branched conduit is connected to the cold water coils of the ice bank assembly, with one branch of the conduit connected to the carbonator and another branch of the conduit connected to the cold water outlet.

According to one aspect of the invention, the front face of the housing includes a front opening through which the filter is mounted into the housing to a fully mounted filtering position. A door is provided for closing the front opening. Complementarily engageable abutment means are provided between the door and the filter to prevent the door from closing if the filter is not in its fully mounted filtering position.

According to another aspect of the invention, the dispensing faucet is readily removably mounted at the front face of the housing by a push/pull action. A cover is mounted on the housing for substantially covering the dispensing faucet except for a dispensing port of the faucet. The faucet is mounted to a complete dispensing position, and the cover is mounted to a fully closed position. Complementary interengaging abutment means are provided between the faucet and the cover to move the faucet to its complete dispensing position automatically as the cover is moved to its fully closed position in the event that the faucet is not fully seated in its dispensing position. The cover holds the faucet in its fully seated position.

Still further, the dispensing faucet has a single dispensing port and three inlet ports one for each of the hot water, cold water and carbonated water. The hot water inlet port is located further from the dispensing port than the cold water inlet port and the carbonated water inlet port so that the hot water helps to sterilize the faucet. Preferably, the dispensing faucet is vertically oriented with a closed top, with the dispensing port being at the bottom of the faucet and with the inlet ports being at a side of the faucet. A vent is provided in the closed top of the faucet to completely drain the faucet when the flow of water from the dispensing port ceases. Finally, the dispensing faucet has three hollow bosses coincident with the three inlet ports and projecting from the faucet. The bosses are insertable into respective outlet ports in the front face of the housing to readily removably mount and remove the faucet to and from the housing by a push/pull action.

In the preferred embodiment of the invention, the tank of the ice bank assembly has a trapezoidal shape in a generally horizontal plane to define a wider end and a narrower end. A bath water circulation pump is located in the tank at the wider end thereof.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
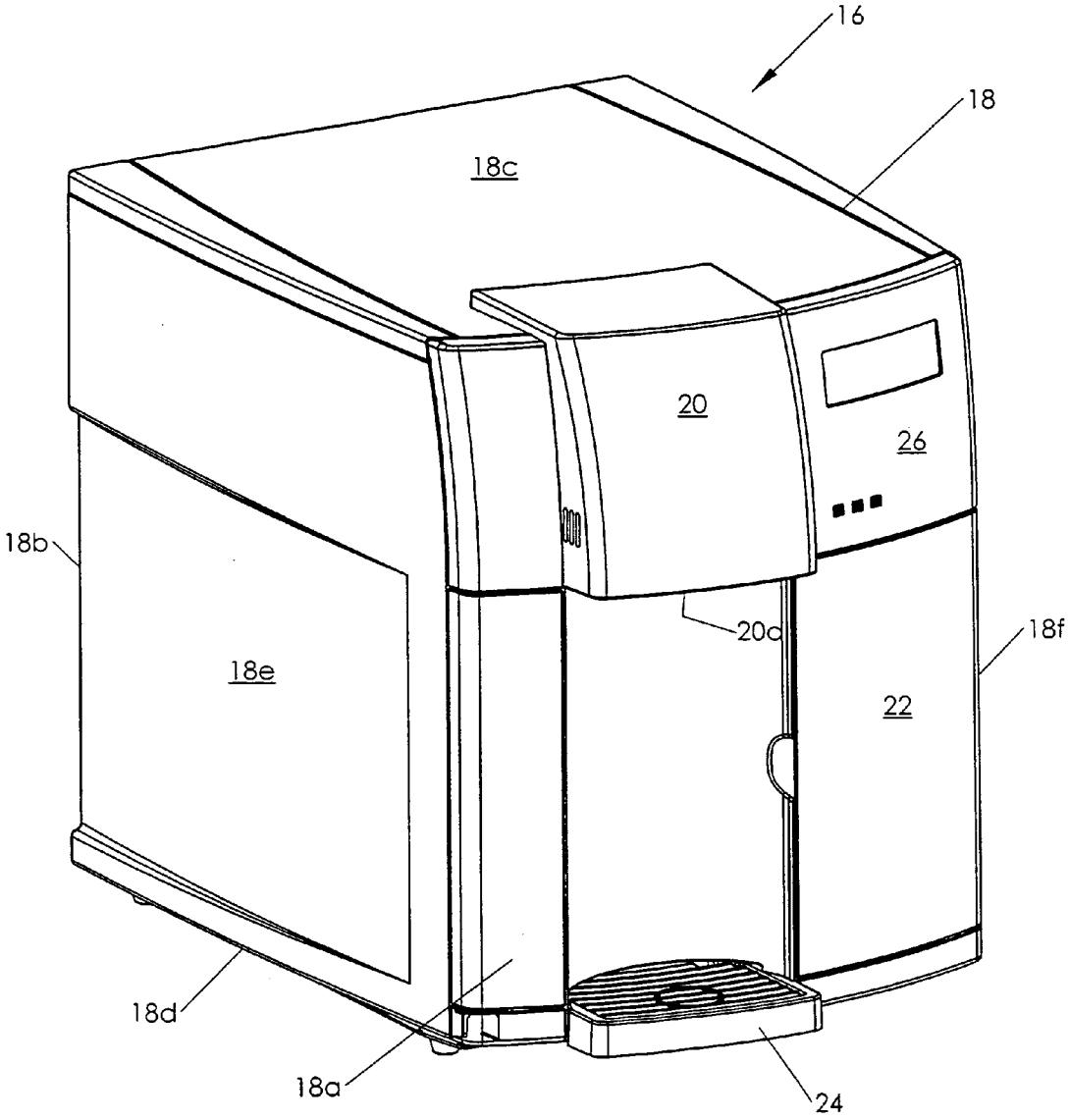
FIG. 1 is a front perspective view of a water dispenser according to the invention.
Figure 2:
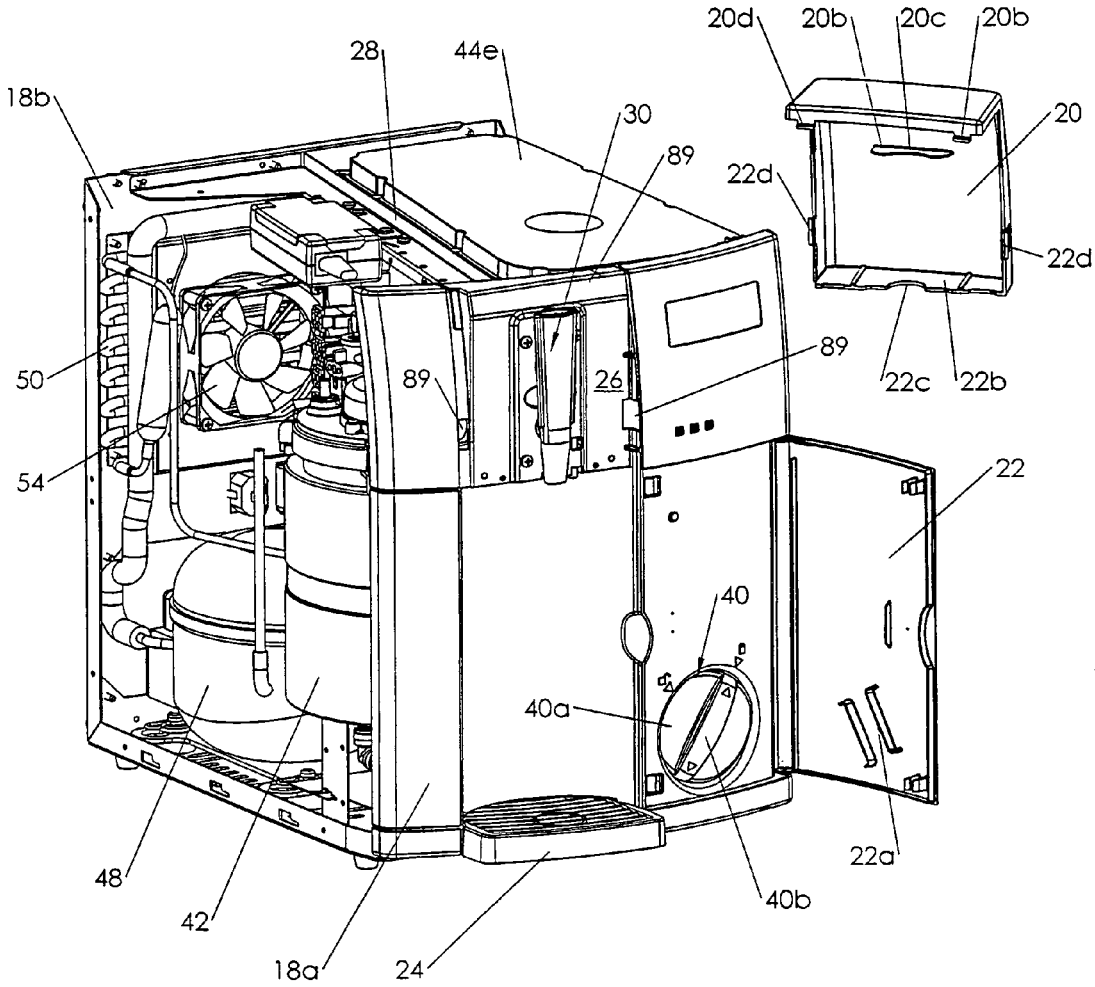
FIG. 2 is a view similar to that of FIG. 1, but with the top wall and two side walls of the housing means removed, along with the faucet cover, to facilitate an illustration of the interior components of the dispenser.
Figure 3:
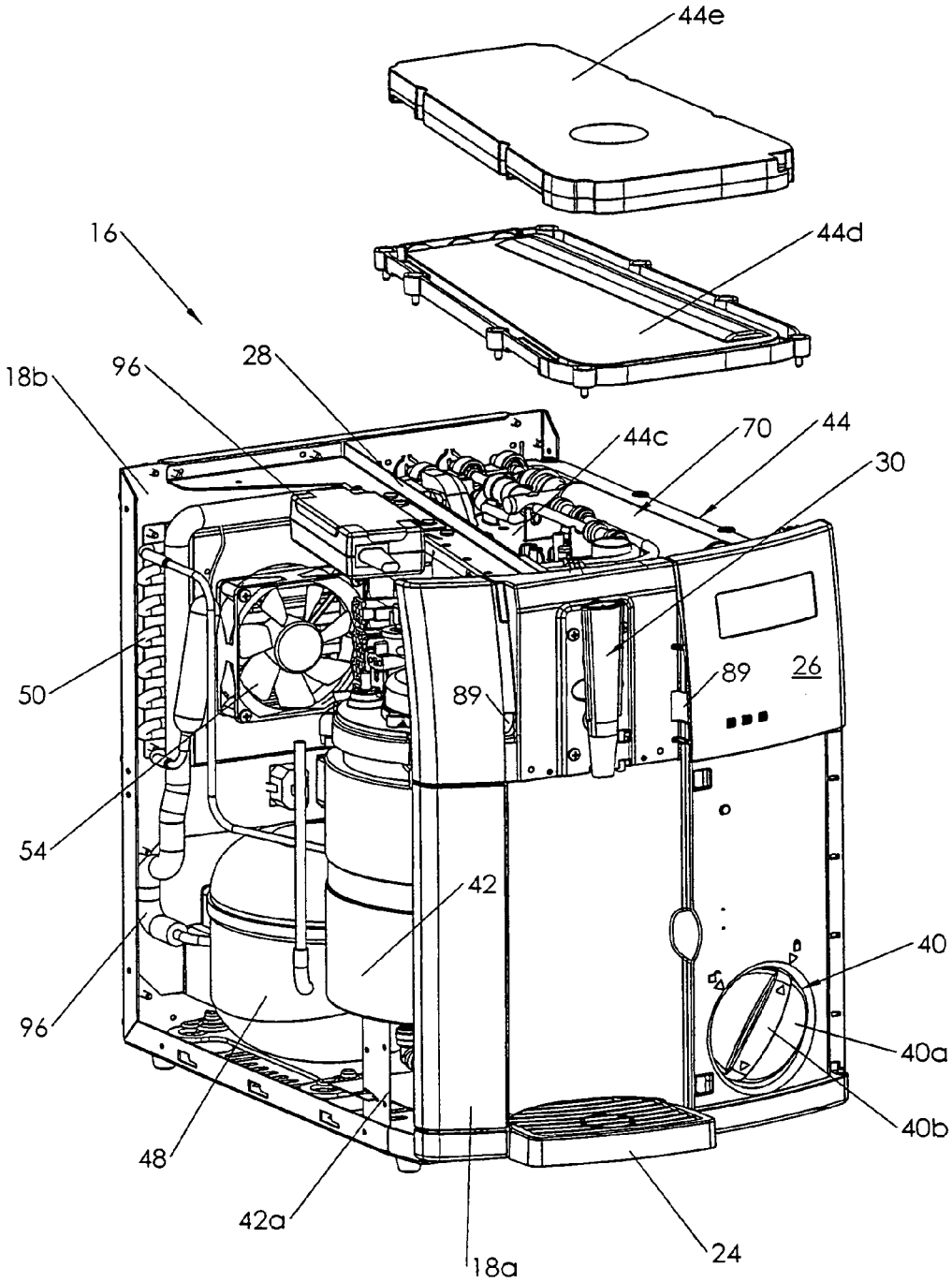
FIG. 3 is a view similar to that of FIG. 2, but with the top cover and top insulation of the ice bank assembly removed therefrom.

Referring to the drawings in greater detail, and first to FIGS. 1-3, the invention is incorporated in a water dispenser, generally designated 16, which includes a housing means ("housing") generally designated 18. As will be understood hereinafter, water dispenser 16 is designed for dispensing hot water, cold water and carbonated water, all of which is filtered. Housing means 18 includes a front wall 18*a*, a rear wall 18*b*, a top wall 18*c*, a bottom wall 18*d* and a pair of opposite left-hand and right-hand side walls 18*e* and 18*f*, respectively. The front and rear walls 18*a* and 18*b*, essentially, define a front dispensing face and a rear face, respectively, of the dispenser.

A faucet cover 20 is snap-mounted at the front face of the housing to cover a faucet (described in detail hereinafter). A filter cover 22 is pivotally mounted at the right of the front face of the housing to afford access to the filter (described in detail hereinafter) of the dispenser. A platform-like glass or cup holder 24 is snap-mounted to the front of the dispenser, spaced below faucet cover 20 and on which a glass, a cup or other beverage container may be positioned below the faucet. A control panel 26 is located above filter cover 22.

As seen in FIGS. 2 and 3, rigid bracing 28 spans the front and rear walls of housing 18 to form a rigid chassis which includes front wall 18*a*, rear wall 18*b* and bottom wall 18*d* of the dispenser. All of the interior components of the dispenser are mounted either on top of the bottom wall, at the inside of the front or rear walls or somewhere within this rigid chassis. By removing top wall 18*c* and side walls 18*e* and 18*f* of the housing (along with faucet cover 20), every interior component of the dispenser has easy access thereto for cleaning, repair or replacement purposes.

Figure 4:
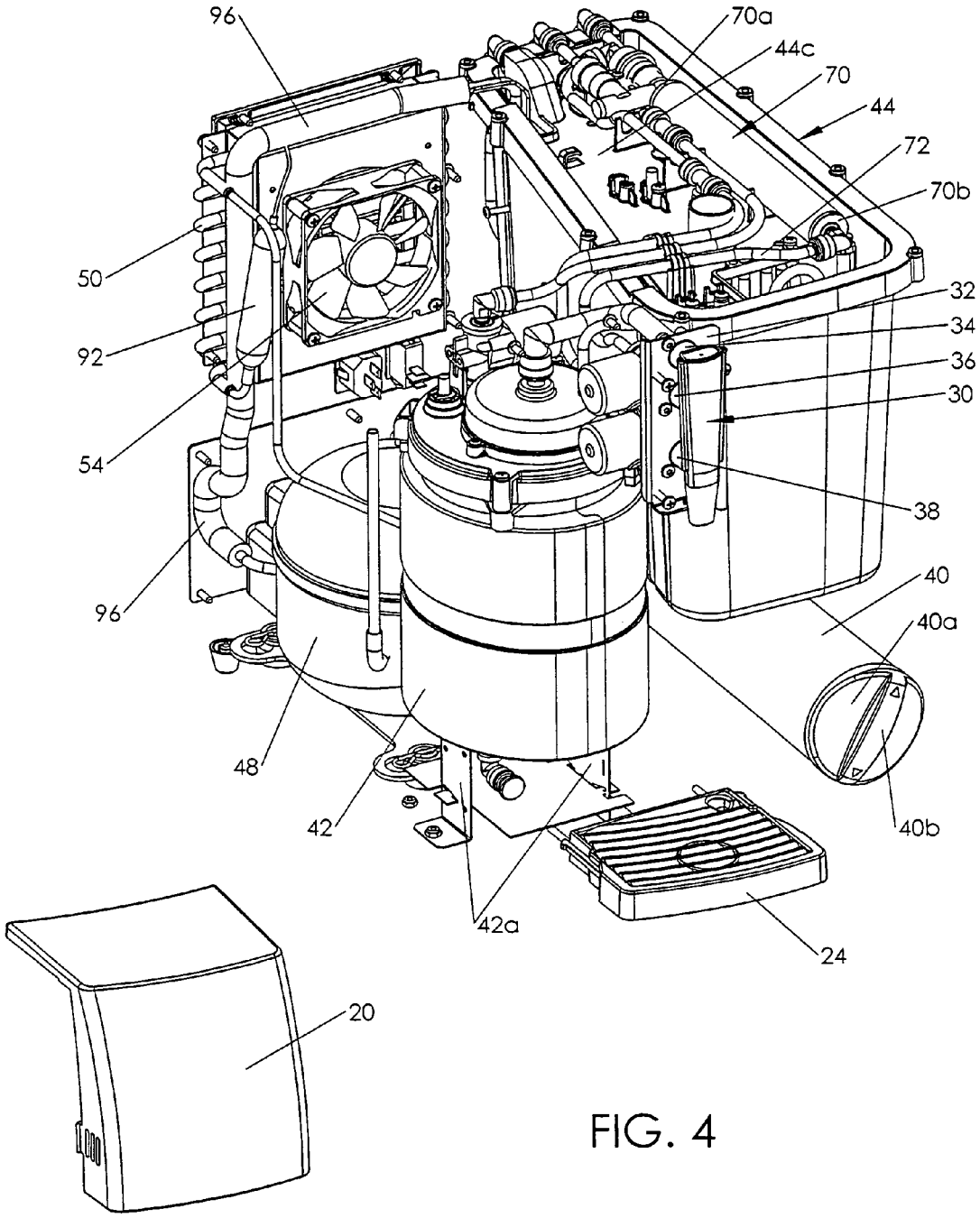
FIG. 4 is a front perspective view of the interior components of the dispenser, isolated from the housing means.
Figure 5:
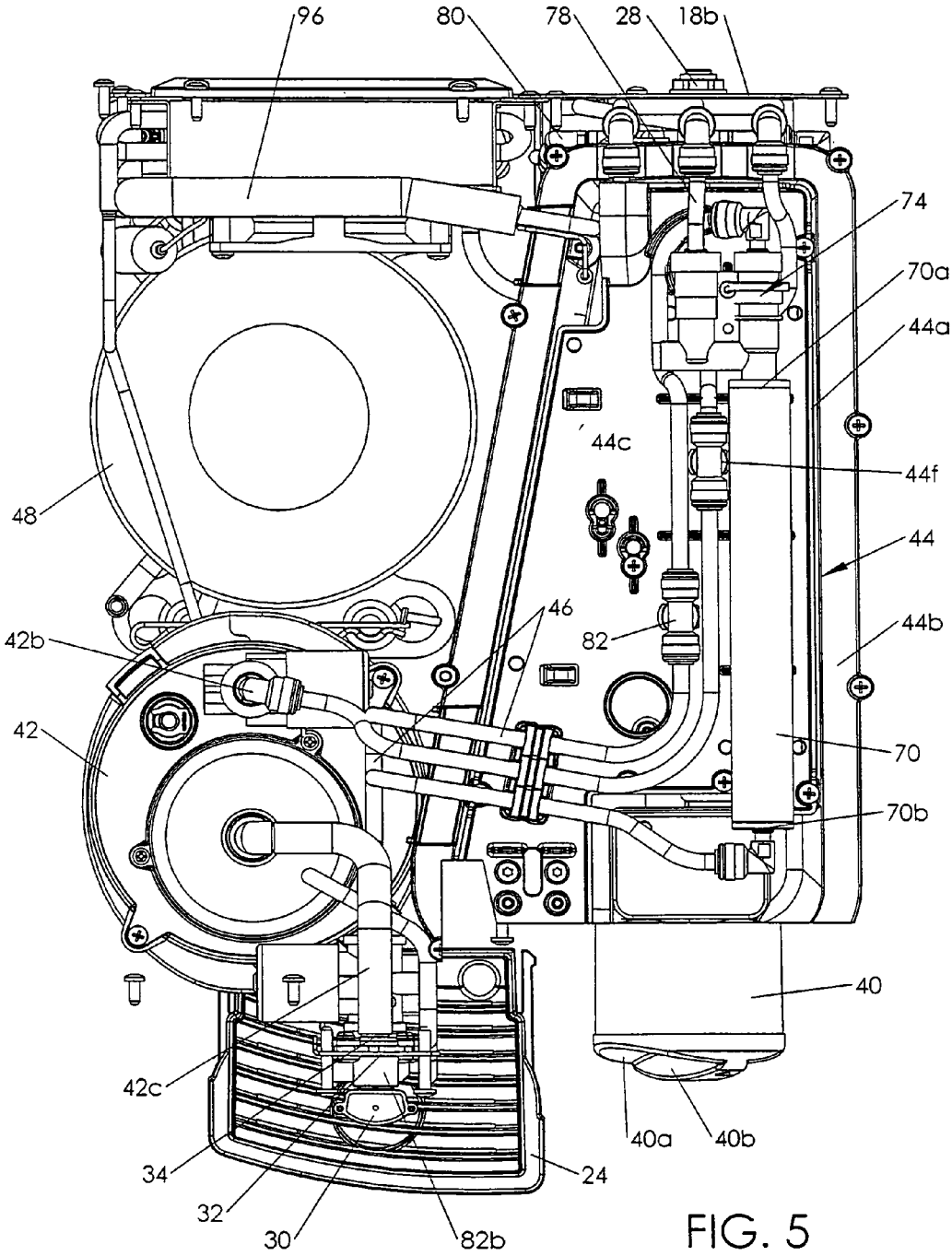
FIG. 5 is a top plan view of the components of FIG. 4.
Figure 6:
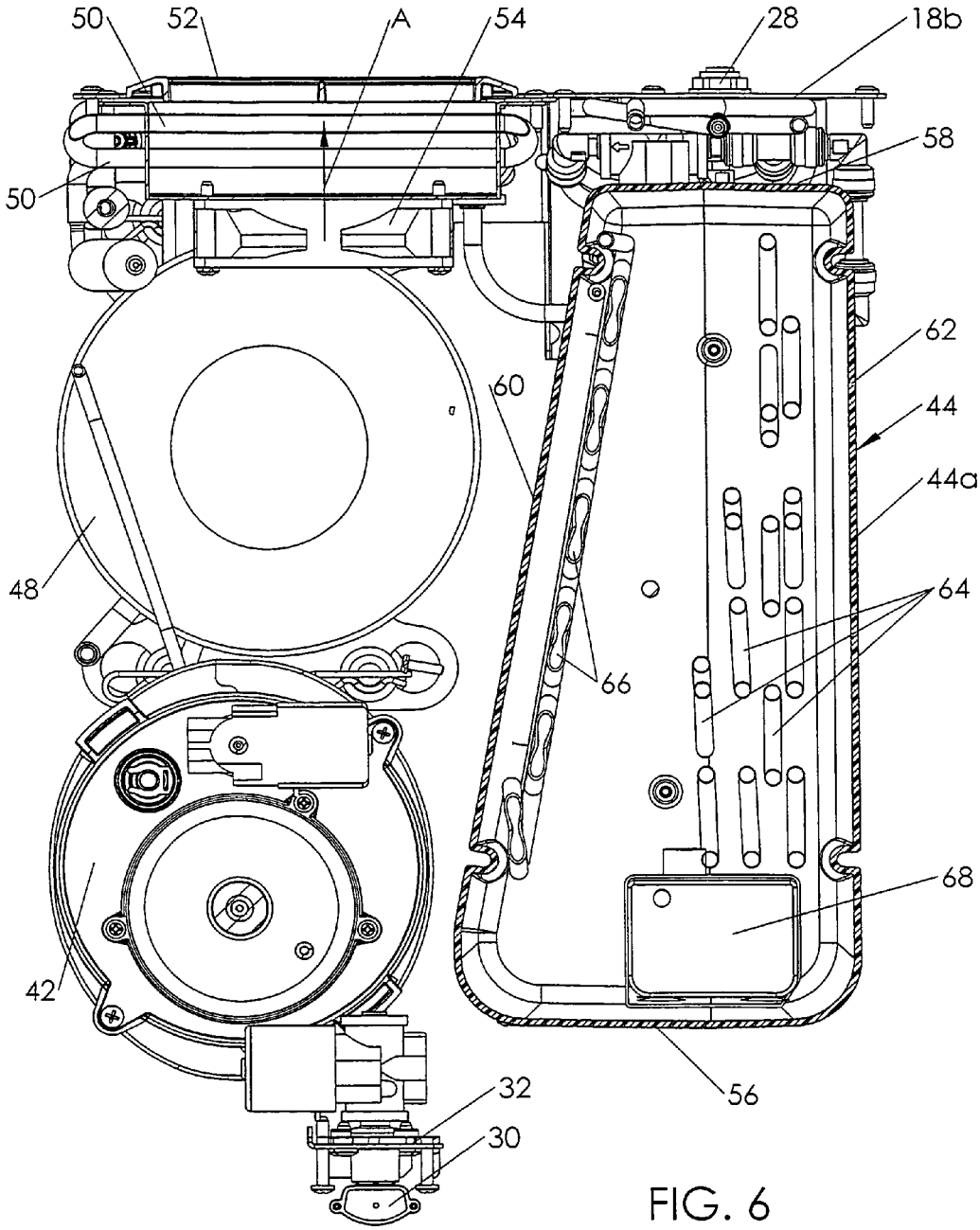
FIG. 6 is a view similar to that of FIG. 5, but with a horizontal section through the tank of the ice bank assembly.
Figure 7:
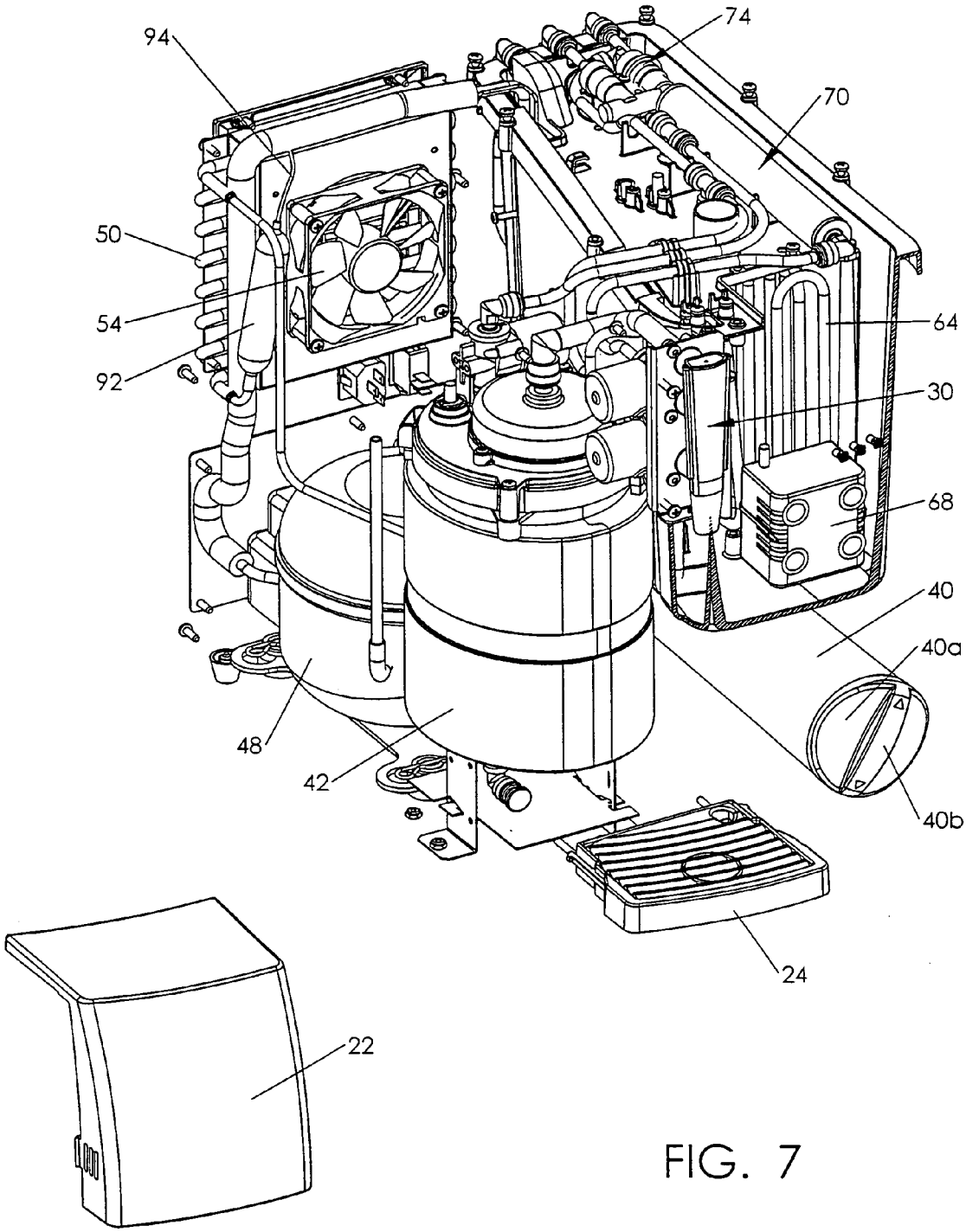
FIG. 7 is a perspective view similar to that of FIG. 4, but showing a vertical section through the front of the tank of the ice bank assembly.
Figure 8:
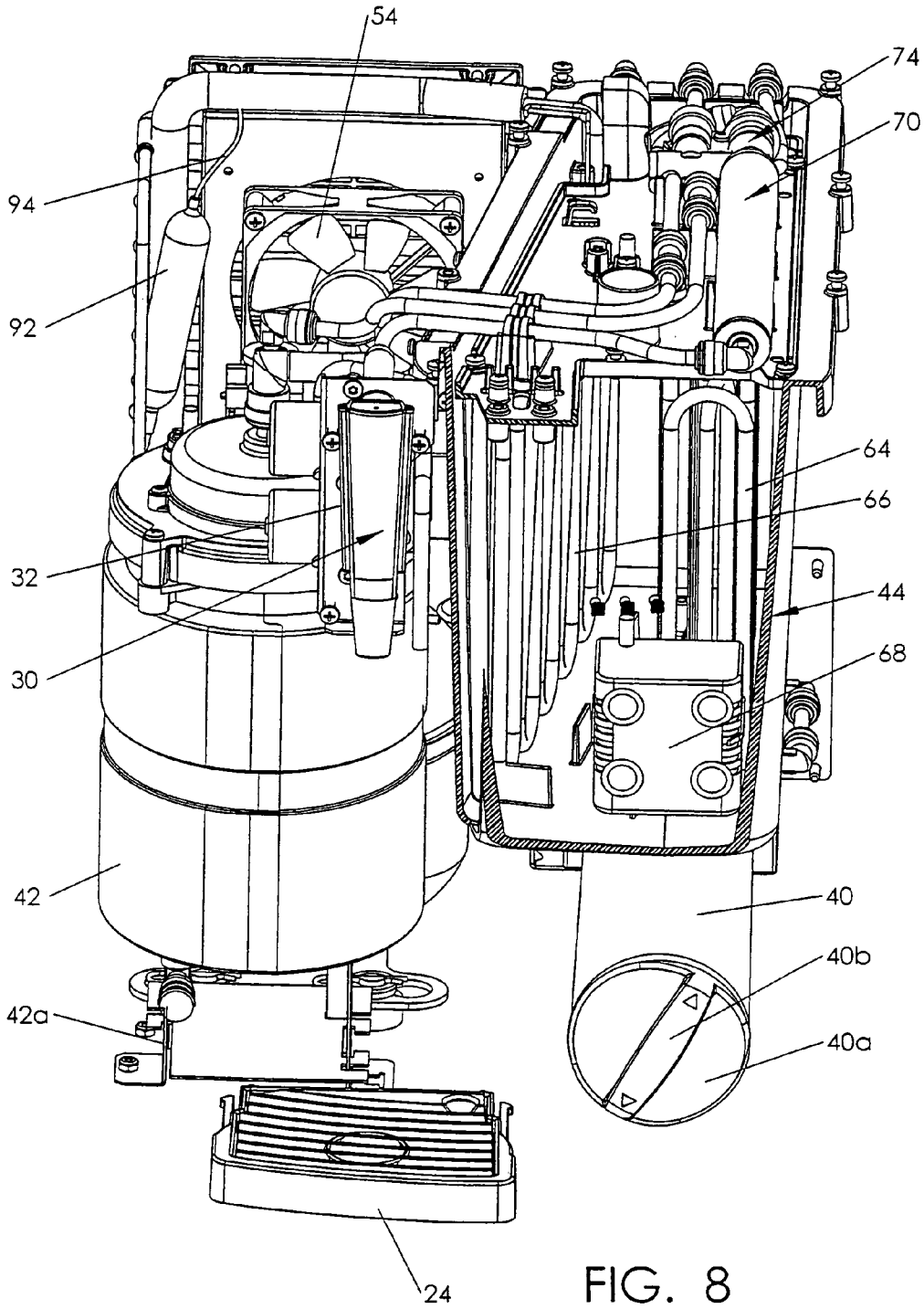
FIG. 8 is a view similar to that of FIG. 7, but with the depiction rotated to a different angle.
Figure 9:
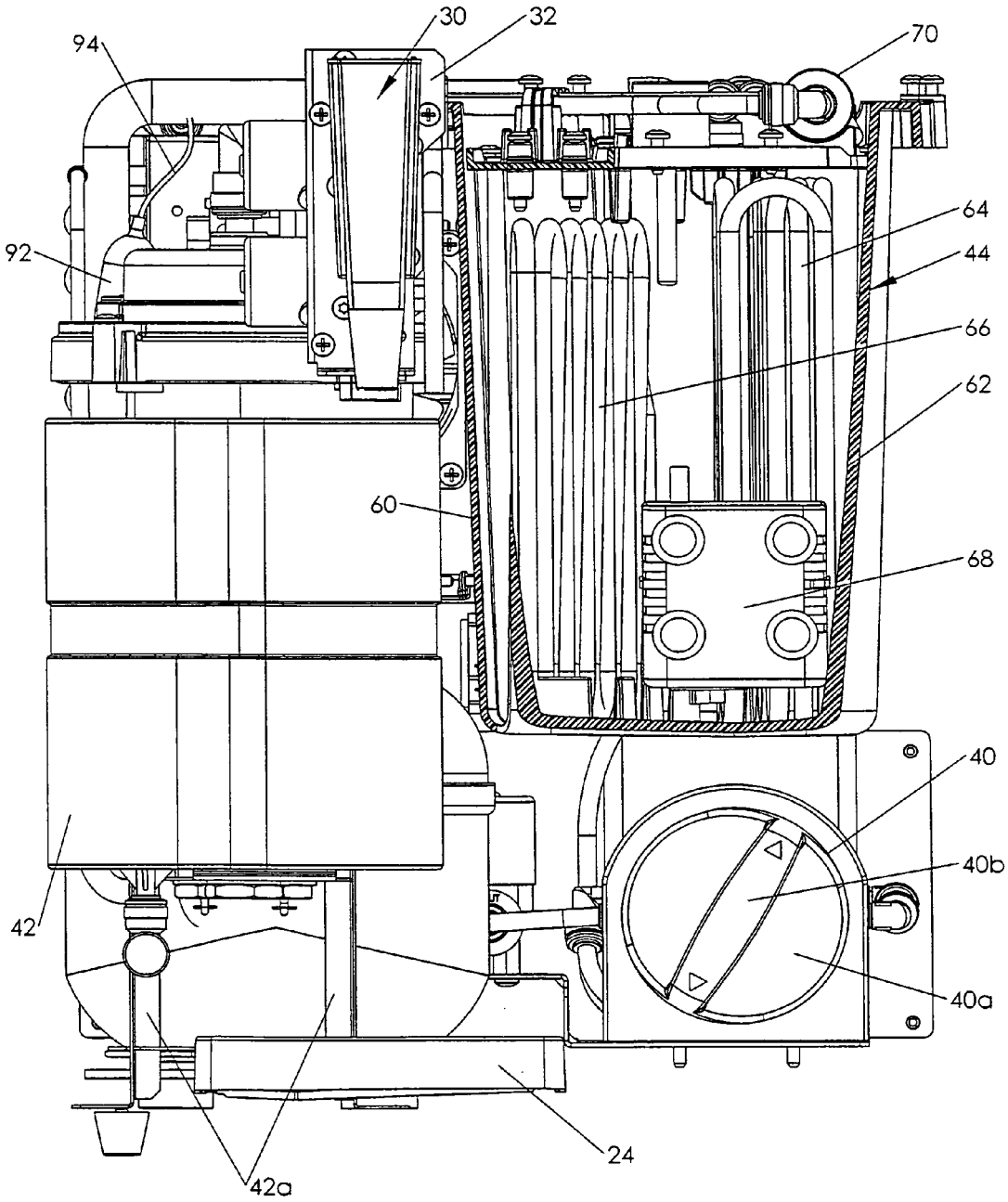
FIG. 9 is a front elevational view of the depictions in FIGS. 7 and 8.

Referring to FIGS. 4-6, an inlet coupling 28 (FIGS. 5 and 6) is located on the outside of rear wall 18*b* of the housing for connection to an appropriate conduit leading to a source of water, such as tap water in a home or office. A singular faucet, generally designated 30, is removably mounted to a dispensing plate 32 which includes a hot water outlet 34, a cold water outlet 36 and a carbonated water outlet 38, all of which are in a vertical linear array behind the vertically elongated faucet.

Still referring to FIGS. 4-6, the interior dispenser component array of dispenser 16 includes an elongated tube-like filter, generally designated 40, which has a rear end connectable to the source of tap water at inlet coupling 28. A front end 40*a* of the filter is accessible at the front face of the housing behind pivoted filter door 22 as can be seen in FIG. 2.

A hot water tank 42 is mounted by appropriate mounting brackets 42*a* (FIG. 4) onto the top of bottom wall 18*d* of the housing as can be seen in FIG. 2. As seen in FIGS. 5 and 6, the hot water tank is located at one side (the left-hand side) of the dispenser component array. The hot water tank has an inlet 42*b* (FIG. 5) for receiving filtered water from filter 40. A conduit 42*c* leads from the hot water tank to the hot water outlet 34 immediately behind faucet 30. By this location of hot water tank 42 at one side of the dispenser component array, very near faucet 30, there is a minimal loss of temperature between the tank and the point where the hot water is dispensed into a cup or other container.

An ice bank assembly, generally designated 44, is mounted on top of bottom wall 18*d* of the housing at one side (the right-hand side) of the dispenser component array. In other words, as seen in FIG. 5, hot water tank 42 is mounted at the left-hand side of the array, and ice bank assembly 44 is mounted at the opposite or right-hand side of the array. Details of the ice bank assembly will be described hereinafter. However, suffice it to say, a tank 44*a* contains a cooling liquid (e.g., water) bath, and the tank is surrounded at least on four sides by a substantial thickness of insulation 44*b*. A transparent top wall 44*c* spans the interior of the tank and, as seen in FIGS. 2 and 3, a layer of insulation 44*d* is disposed immediately above a removable cover 44*e* of the assembly. The ice bank assembly has an inlet 44*f* for receiving filtered water from the filter with the inlet connected to an array of cold water coils (described hereinafter) within the tank. Cold water leaves the tank at an outlet 44*g* and passes through a conduit 46 to the cold water outlet 36 (FIG. 4) behind faucet 30. Therefore, like the outlet of hot tank 42, the outlet of the ice bank assembly also is near the dispensing faucet.

A compressor 48 is mounted on the bottom wall of the housing immediately behind hot tank 42 and, like the hot tank, to one side of the dispenser component array from the ice bank assembly 44. A condenser coil 50 is mounted to the inside of rear wall 18*b* of the housing, and the condenser coil is mounted behind a perforated portion 52 of the rear wall as can be seen clearly in FIG. 6. A fan 54 is mounted to the inward side of the condenser coil for blowing air past the condenser coil, in the direction of arrow "A" (FIG. 6), out through perforated portion 52 and into the atmosphere. The relationship of compressor 48 and condenser coil 52 in conjunction with the evaporator coils within the tank of the ice bank assembly will be described hereinafter in relation to the flow diagram of FIG. 13.

Referring to the sectioned views of FIGS. 7-11 in conjunction with the sectional view of FIG. 6, it can be seen that the tank 44*a* of ice bank assembly 44 is generally trapezoidal in a horizontal plane to define a wider end 56 (FIG. 6) and a narrower end 58, along with a pair of sides 60 and 62 which sort of converge rearwardly toward the narrower end 58. A flat array of cold water coils 64 are located at one side of tank 44*a*, and the cold water coils are immersed in the cooling bath within the tank. A generally flat array of evaporator coils 66 are effective to form a generally planar ice bank or slab of ice extending rectilinearly in a direction between the front and rear faces of the dispenser and its housing. The cold water coils are connected to the cold water outlet 36 (FIG. 4) behind faucet 30, as will be seen in greater detail hereinafter in describing the flow diagram of FIG. 14. With the trapezoidal tank, a circulation pump 68 is mounted at the wider end of tank 44*a* for circulating the cooling liquid bath within the tank.

In the embodiment described above, the space between the flat array of cold water coils 64 and the planar face of the ice slab formed by the flat array of evaporator coils 66 form an effective path for the cooling bath to be circulated by pump 68. The bulk of the bath water lies between the cold water coils and the face of the ice slab, and the pumped flow of cooling water is relatively unobstructed. This configuration and spacing, along with the shape and size of the ice bank assembly all combine to reduce the volume of the bath water relative to the area of the face of the ice slab and helps to increase the velocity of the bath water past both the ice slab face and the cold water coils. This promotes a more effective transfer of heat away from the cold water coils.

Referring to all of FIGS. 5, 6 and 7-11, an elongated, tube like carbonator, generally designated 70, is mounted inside tank 44*a* of the ice bank assembly 44. Specifically, it can be seen that the carbonator is mounted above top wall 44*c* of the tank but inside the insulation layer 44*d* (FIG. 3) and the top cover 44*e* of the tank. The elongated carbonator 70 has an inlet end 70*a* and an outlet end 70*b*. The outlet end is nearer faucet 30 and is connected by a conduit 72 to the carbonated water outlet 38 (FIG. 4) behind the faucet. The carbonator includes a manifold, generally designated 74, connected to inlet end 70*a* of the carbonator. Water and gas are introduced to the carbonator at the manifold. A conduit 76 (FIG. 5) feeds cold water from the cold water coils 64 within the ice bank assembly to the manifold 74 of the carbonator. Another conduit 78 leads from the manifold 74 of the carbonator down to a supply of carbonating gas, such as a $CO_2$ tank 80 shown in FIG. 5 at the rear of the dispenser at the bottom of the ice bank assembly. Further details of the structure and operation of the carbonator can be seen from co-pending application Ser. No. 11/194,313 which was filed Aug. 1, 2005, assigned to the assignee of the present invention, and which is incorporated herein by reference.

Looking at FIG. 5, it can be seen that a branched coupling 82 is disposed at the cold water outlet 44*g* from ice bank assembly 44. In other words, the cold water from the outlet can lead in two directions. It can be seen that one end of coupling 32 is connected to the cold water conduit 46 leading to the cold water outlet 36 at the faucet, and the other side of the branch coupling is connected to conduit 76 which feeds cold water to carbonator 70.

As stated above, front end 40*a* of filter 40 is located in an opening in front wall 22 of the dispenser housing so that the filter can be easily grasped by a person to remove and replace or service the filter. Pivoted door 22 closes this opening and hides the filter. FIG. 2 shows door 22 in an open position. The front face of the filter has a projecting rib 40*b* and the back side of door 22 has a slot 22*a*. In the particular embodiment herein, the filter is rotated to a fully mounted or seated filtering position. At that position, rib 40*b* at the front of the filter is aligned with slot 22*a* at the back side of the door. When so aligned, the door can completely close. However, if the filter is not fully rotated or seated, the door cannot close and, in essence, renders a visual signal that the filter is not properly mounted or seated. In essence, the Interengaging surface of the rib and slot define complementary, interengaging abutment means between the door and the filter to prevent the door from closing if the filter is not in its fully mounted position.

Figure 12C:
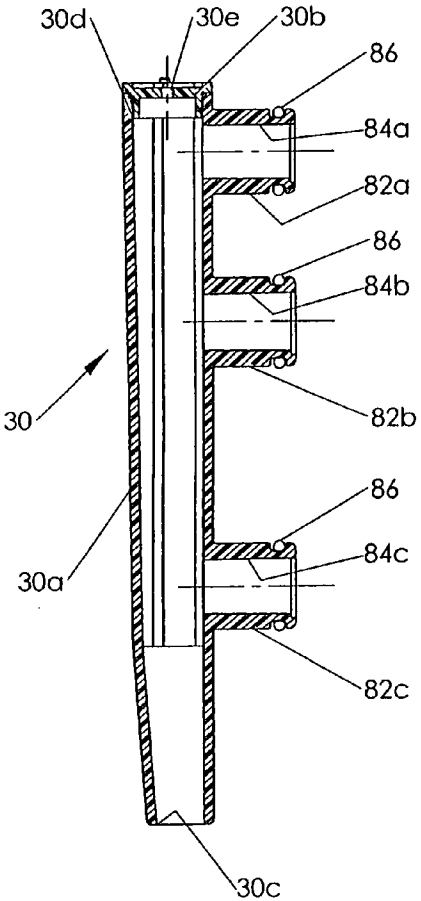
FIG. 12C is a central, vertical section through the faucet.
Figure 12B:
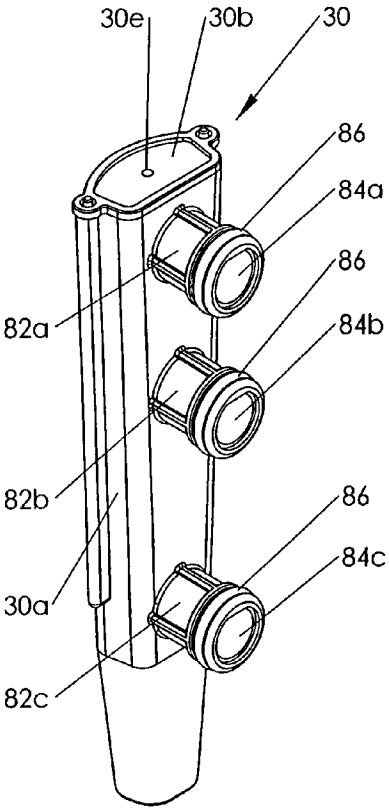
FIG. 12B is a rear perspective view of the faucet.
Figure 12A:
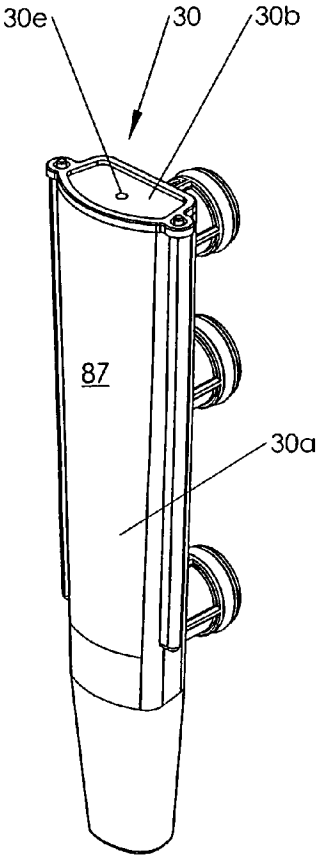
FIG. 12A is a front perspective view of the faucet of the dispenser.

Referring to FIGS. 12A-12C, dispensing faucet 30 could be fabricated as a one-piece structure unitarily molded of transparent plastic material. However, for molding convenience, faucet 30 is molded as a two-piece structure including an elongated tubular body 30*a* and a top cap 30*b*. The tubular body is open-ended and has a single dispensing port 30*c* at the bottom thereof, and a top opening 30*d* which is closed by top cap 30*b*. The top cap can be secured at the top of the body, closing top opening 30*d*, by an adhesive, ultrasonic welding or the like. The faucet is mounted in a vertical orientation as shown in FIG. 12A-12C and as can be seen clearly in FIG. 4. Top cap 30*b* includes a vent in the form of an orifice 30*e* to ensure that the faucet is completely drained when the flow of water from dispensing port 30*c* ceases.

Still referring to FIGS. 12A-12C, faucet 30 has three hollow bosses or nipples 82*a*, 82*b* and 82*c* projecting outwardly from one side of body 30*a* in a linear vertical array. The hollow bosses communicate with the interior of body 30*a* and dispensing portion 30*c* and respectively define three inlet ports 84*a*, 84*b* and 84*c*. The three inlet portions are for dispensing hot water, cold water and carbonated water from the dispenser. The hollow bosses are mounted to dispensing plate 32 (FIG. 4) by inserting the bosses into sockets formed by hot water outlet 34, cold water outlet 36 and carbonated water outlet 38. As described in relation to FIG. 4, hot water outlet 34 is at the top of this vertical array. Therefore, hot water inlet port 84*a* of faucet 30 is at the top of the faucet or above the hot water inlet port 84*b* and the carbonated water inlet portion 84*c* so that the hot water flushed downwardly and helps to sterilize the faucet. Three resilient O-rings 86 are seated in respective annular recesses about bosses 82*a*, for sealing the faucet and the inlet ports when they are inserted into the outlet sockets in dispensing plate 32. As will be seen in the description of the flow diagram in FIG. 14, dispensing valves are located in hot water outlet 34, cold water outlet 36 and carbonated outlet 38. Therefore, bosses 82*a*-82*c* can be inserted directly into outlet ports of the valves and the faucet is readily removable for cleaning or replacement purposes in a push/pull action. No tools or twisting motion are required.

As stated above, faucet 30 is mounted at the front dispensing face of the dispenser, to dispensing plate 32, as can be seen clearly FIGS. 4-7. When faucet cover 20 is mounted on housing 18 as seen in FIG. 1, faucet 30 is completely hidden except that the cover has a bottom opening 20*a* through which liquid can be dispensed from bottom dispensing port 30*c* of the faucet.

Referring to FIG. 2, the back side of faucet cover 20 is provided with a pair of abutment flanges 20*b* having arcuate abutment surfaces 20*c* which are on a curvature to match the curvature of a front face 87 (FIG. 12A) of faucet 30. The abutment flanges are located so that if faucet 30 is not mounted to its complete or fully inserted dispensing position, the cover will move the faucet to its fully inserted dispensing position automatically as the cover is mounted to its fully closed position. In essence, abutment surfaces 20*c* on cover 20 and front face 87 of the faucet form complementarily engageable abutment means between the faucet and the cover to move the faucet to its fully inserted dispensing position automatically as the cover is moved to its fully closed position, in the event that the faucet is not fully seated. The cover is held onto the front wall 18*a* of the housing by a plurality of latches 20*d* (FIG. 2) which are snapped into a plurality of latch holes 89 in the front wall.

Figure 10:
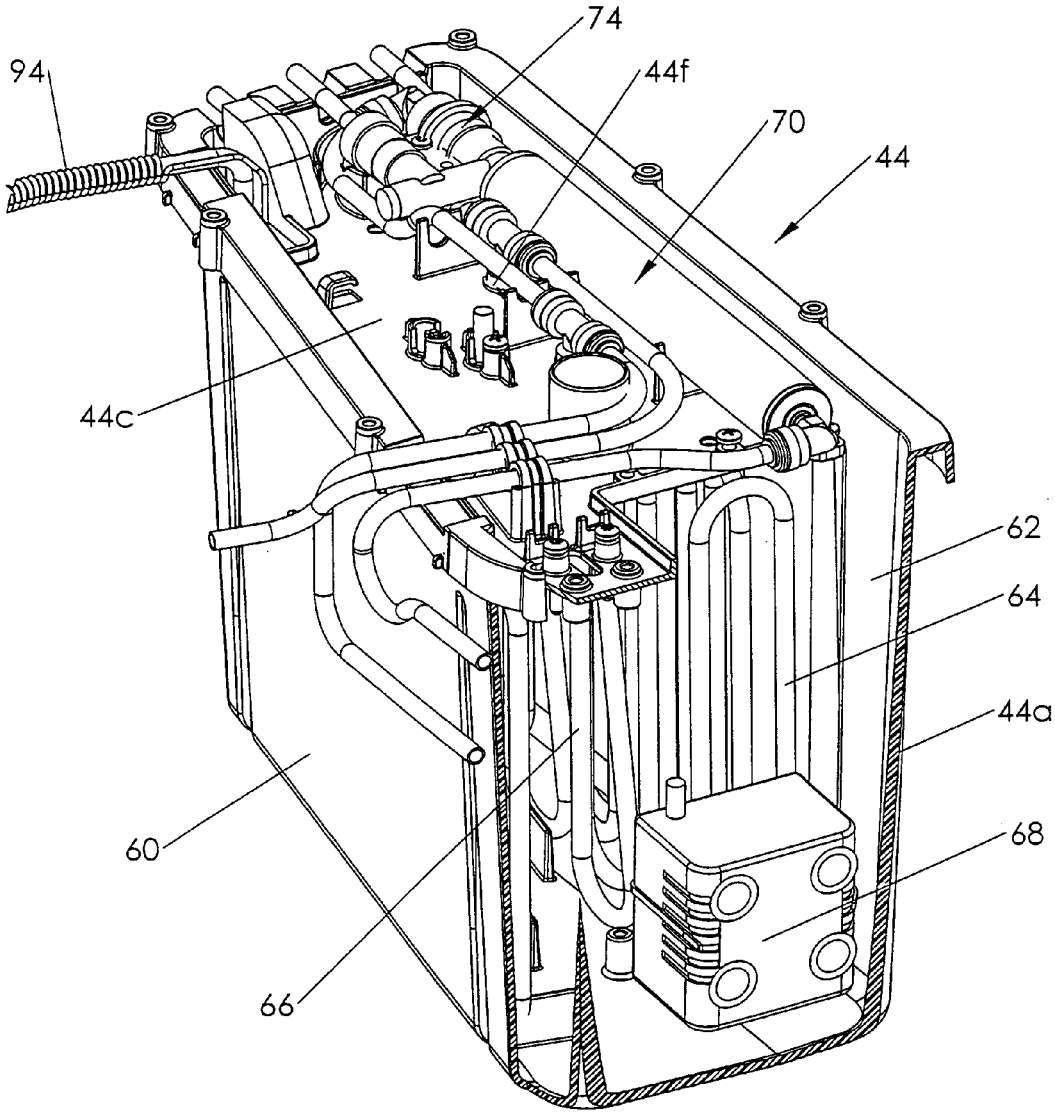
FIG. 10 is an enlarged front elevational view of the ice bank assembly, with the top cover and insulation removed, and with a vertical section through the front of the tank of the assembly.
Figure 11:
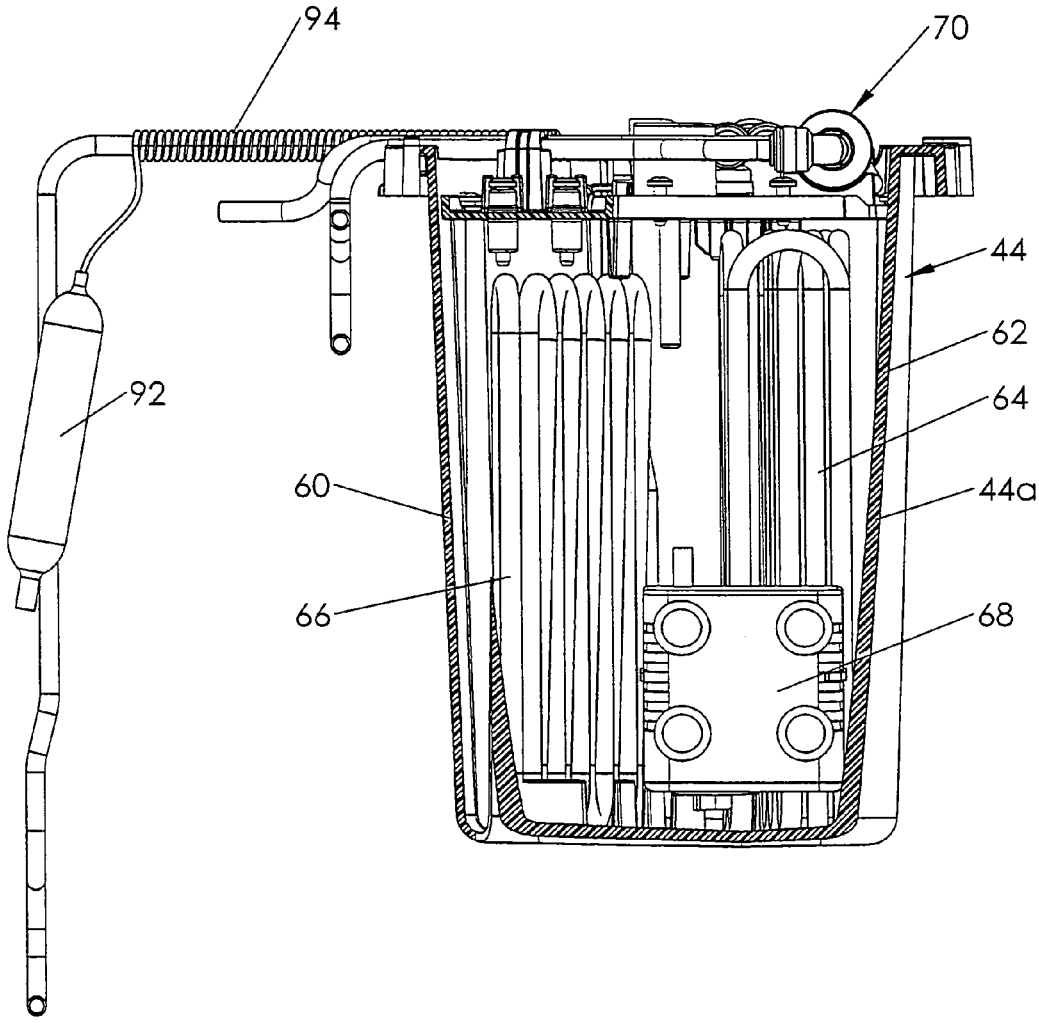
FIG. 11 is a vertical section corresponding to the perspective depiction in FIG. 10.
Figure 13:
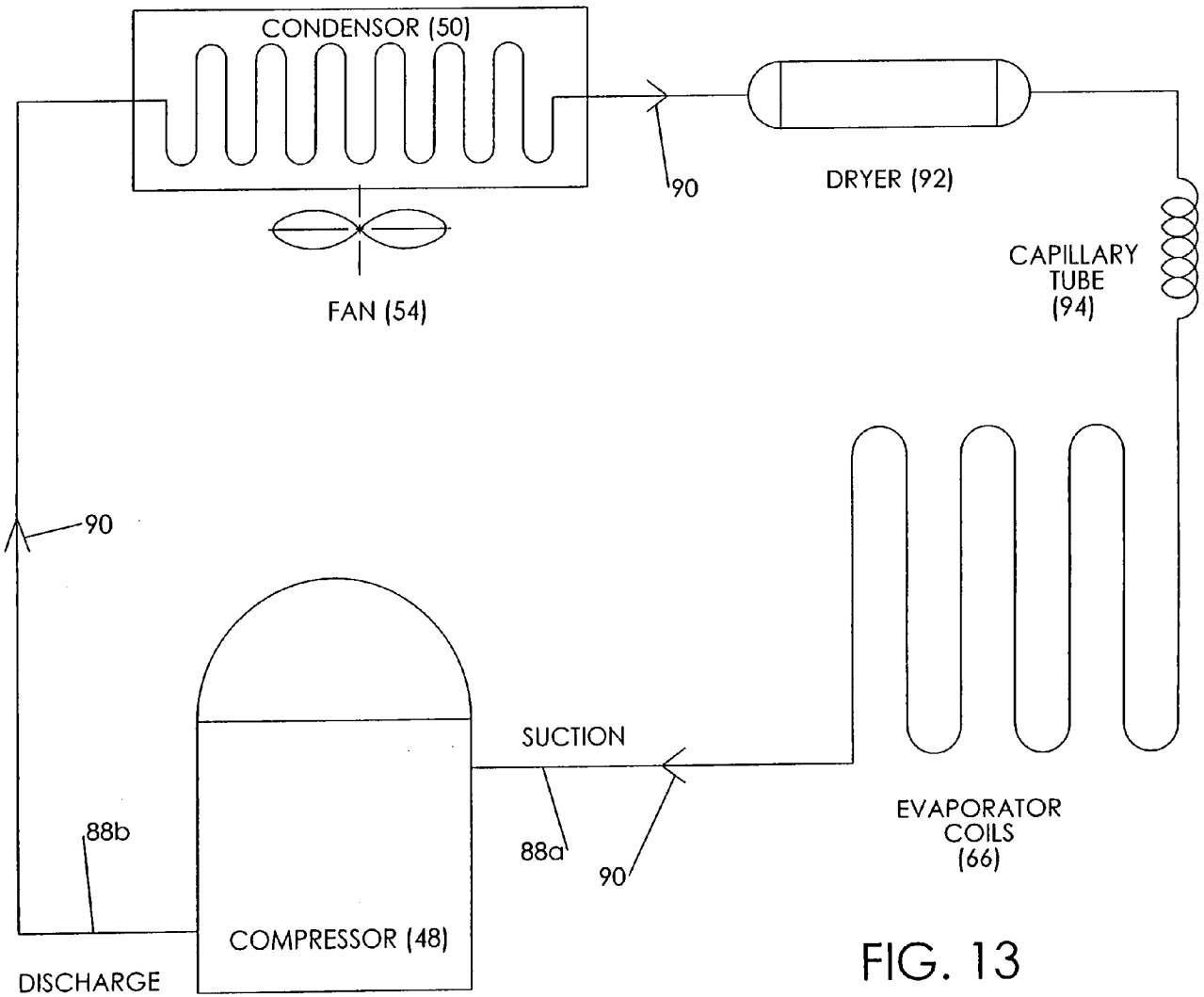
FIG. 13 is a flow diagram of the refrigeration system for the evaporator coils in the ice bank assembly.

As stated above, FIG. 13 shows a flow diagram of the refrigeration system of dispenser 16. Specifically, compressor 48 has a suction side 88*a* and a discharge side 88*b* whereby the refrigerant flows through the system in a generally clockwise direction (as viewed in the drawings) in the direction of arrows 90. The refrigerant moves from compressor 48 through condenser coils 50 and then to a dryer 92 which can be seen clearly in FIGS. 4, 7 and 8, for instance. The refrigerant leaves dryer 92 and passes through a capillary tube 94 and then to the evaporator coils 66 described above. Most of the conduits are covered by insulation 96 as can be seen in FIG. 4. However, FIGS. 10 and 11 show that capillary tube 94 is wrapped in a coil-like configuration and is of a considerably smaller diameter than the other conduits. The coiled configuration provides a very long path for the capillary tube and, as the refrigerant is passed through and out of the capillary tube, it expands considerably when it reaches the larger diameter evaporator coils.

It would seriously encumber the drawings to reference all of the conduits which lead to the interior components of the dispenser. Many of the conduits are shown in the drawings, but others are hidden behind or beneath the components. Therefore, in order to avoid an undue number of drawing views, FIG. 14 shows a water flow chart, with the understanding that each of the conduits or lines on the chart represent the necessary conduits or "plumbing" for the dispenser.

Figure 14:
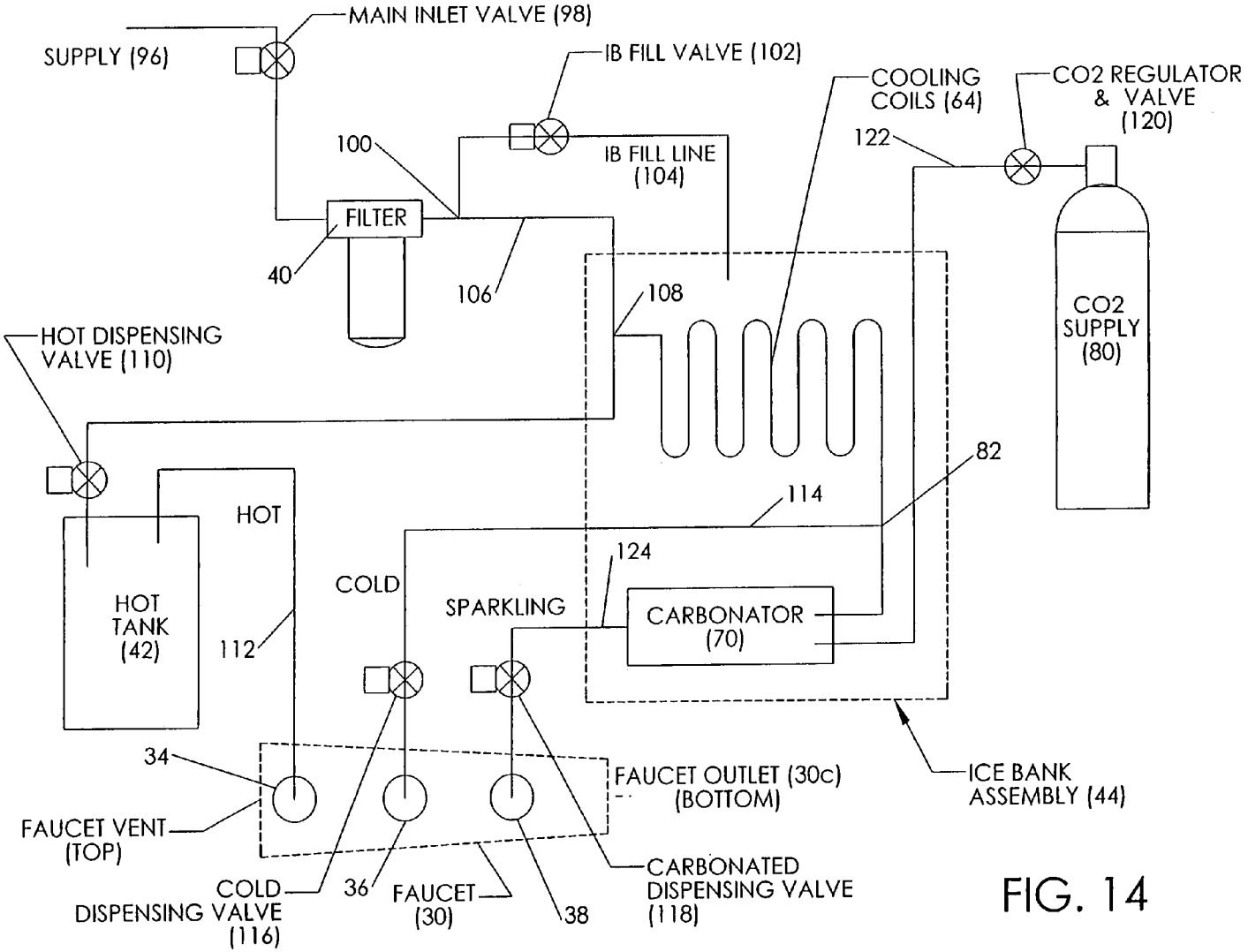
FIG. 14 is a flow diagram of the water and $CO_2$ supply for the dispenser.

With the above understandings, FIG. 14 shows a water supply 96 which would be appropriately connected to the main inlet coupling 28 (FIG. 5) and to a main inlet valve 98. At this point, it should be understood that all of the valves would be connected either by hard wiring or through microprocessors to control components at control panel 26 at the front of the dispenser as shown in FIG. 1. The water then is fed to a branch 100 whereat the water is fed through an ice bank fill valve 102 and an ice bank fill line 104 to the tank of ice bank assembly 44. Another line or conduit 106 leads to a second branch 108 whereat water is fed in both directions to the cooling coils 64 in the ice bank and through a hot water dispensing valve 110 to hot water tank 42. Upon actuation of the hot water dispensing valve, hot water is fed through line 112 to hot water outlet 34 (FIG. 4) and to the hot water port of faucet 30. Cold water is fed from the ice bank through a line 114 to a cold water dispensing valve 116 and to the cold water outlet 36 (FIG. 4) and to the faucet as described above. Cold water also is fed from the ice bank through branch coupling 82 (FIG. 5) to carbonator 70 and through a carbonated water dispensing valve 118 to the carbonated water outlet 38 (FIG. 4) at faucet 30. Gas is supplied to the carbonator from supply 80, through a regulator valve 120 and line 122, to function as described above. The carbonated water dispensing valve 118 is located in a line 124 leading from the carbonator to the carbonated water outlet 38 (FIG. 4) at faucet 30.

With the system of the invention, the cold water is sealed all the way from filter 40 to the cold water outlet 38 at faucet 30. The cold water is sealed within cooling coils 64 and is purged each time cold water is dispensed. Since there is no reservoir, the cold water is continuously replaced in a sealed, continuous water path.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

The invention claimed is:

1. A water dispenser for dispensing hot and cold water, comprising: a housing including a front dispensing face having hot and cold water outlets; hot water means in the housing for delivering hot water to the hot water outlet; cold water means in the housing for delivering cold water to the cold water outlet; and a singular dispensing faucet readily removably mounted at the front face of the housing in communication with said hot and cold water outlets; a cover mounted on the housing for substantially covering the dispensing faucet except for a dispensing port of the faucet; said dispensing faucet is mounted to a complete dispensing position and the cover is mounted to a fully closed position, and including complementarily engageable abutment means between the faucet and the cover to move the faucet to its complete dispensing position automatically as the cover is moved to its fully closed position in the event that the faucet is not fully seated in its dispensing position; and the faucet being mounted to and removed from the housing by a push/pull action.

2. The water dispenser of claim 1 wherein said dispensing faucet has a single dispensing port and two inlet ports connectable to said hot and cold water outlets.

3. The beverage dispenser of claim 2 wherein the hot water inlet port is located above the dispensing port than the cold water inlet port so that the hot water helps to sterilize the faucet.

4. The beverage dispenser of claim 2 wherein said dispensing faucet is vertically oriented with a closed top, with the dispensing port being at the bottom of the faucet and with the inlet ports being at a side of the faucet.

5. The beverage dispenser of claim 4 wherein said dispensing faucet has a vent in the closed top thereof to completely drain the faucet when the flow of water from the dispensing port ceases.

6. The beverage dispenser of claim 2 wherein said dispensing faucet has two hollow bosses coincident with the two inlet ports and projecting from the faucet, the bosses being insertable into respective outlet ports in the front face of the housing to readily removably mount the faucet to the housing by said push/pull action.

7. A water dispenser for dispensing hot and cold water, comprising: a housing including a front dispensing face having hot and cold water outlets; hot water means in the housing for delivering hot water to the hot water outlet; cold water means in the housing for delivering cold water to the cold water outlet; a singular dispensing faucet readily removably mounted at the front face of the housing in communication with said hot and cold water outlets; said dispensing faucet has a single dispensing port and two inlet ports connectable to said hot and cold water outlets; a cover mounted on the housing for substantially covering the dispensing faucet except for a dispensing port of the faucet; and said dispensing faucet being mounted to a complete dispensing position and the cover is mounted to a fully closed position, and including complementarily engageable abutment means between the faucet and the cover to move the faucet to its complete dispensing position automatically as the cover is moved to its fully closed position in the event that the faucet is not fully seated in its dispensing position.

8. The beverage dispenser of claim 7 wherein the hot water inlet port is located further from the dispensing port than the cold water inlet port so that the hot water helps to sterilize the faucet.

9. The beverage dispenser of claim 7 wherein said dispensing faucet is vertically oriented with a closed top, with the dispensing port being at the bottom of the faucet and with the inlet ports being at a side of the faucet.

10. The beverage dispenser of claim 9 wherein said dispensing faucet has a vent in the closed top thereof to completely drain the faucet when the flow of water from the dispensing port ceases.

11. The beverage dispenser of claim 7 wherein said dispensing faucet has two hollow bosses coincident with the two inlet ports and projecting from the faucet, the bosses being insertable into respective outlet ports in the front face of the housing to readily removably mount the faucet to the housing by said push/pull action.

* * * * *